US009321575B2

(12) United States Patent
Nakamura

(10) Patent No.: US 9,321,575 B2
(45) Date of Patent: Apr. 26, 2016

(54) PULP MOLDED CUSHIONING MATERIAL AND PACKING CASE PROVIDED WITH SAME

(71) Applicant: KYOCERA DOCUMENT SOLUTIONS INC., Osaka (JP)

(72) Inventor: Toshiyuki Nakamura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 31 days.

(21) Appl. No.: 14/011,623

(22) Filed: Aug. 27, 2013

(65) Prior Publication Data

US 2014/0061088 A1 Mar. 6, 2014

(30) Foreign Application Priority Data

Aug. 29, 2012 (JP) ..... 2012-189226

(51) Int. Cl.
*B65D 81/02* (2006.01)
*B65D 81/05* (2006.01)
*B65D 5/50* (2006.01)

(52) U.S. Cl.
CPC ..... *B65D 81/022* (2013.01); *B65D 5/5069* (2013.01); *B65D 81/055* (2013.01); *B65D 2585/689* (2013.01)

(58) Field of Classification Search
CPC .. B65D 81/058; B65D 81/055; B65D 81/022; B65D 5/5069; B65D 5/5071; B65D 2585/689; B65D 2585/6892; B65D 81/054
USPC ..... 206/521, 591, 586–587
See application file for complete search history.

(56) References Cited

U.S. PATENT DOCUMENTS

| | | | | |
|---|---|---|---|---|
| 5,398,808 | A * | 3/1995 | Chen et al. | 206/320 |
| 6,405,873 | B2 * | 6/2002 | Koike | 206/592 |
| 7,114,618 | B2 * | 10/2006 | Arnold | 206/523 |
| 2001/0020595 | A1 | 9/2001 | Koike | |
| 2006/0102516 | A1 * | 5/2006 | Ho | 206/592 |
| 2012/0103854 | A1 | 5/2012 | Ooi et al. | |

FOREIGN PATENT DOCUMENTS

JP 2001-240143 A 9/2001

OTHER PUBLICATIONS

The extended European search report issued by the European Patent Office on Dec. 5, 2013, which corresponds to European Patent Application No. 13181784.3-1708 and is related to U.S. Appl. No. 14/011,623.

* cited by examiner

*Primary Examiner* — Anthony Stashick
*Assistant Examiner* — Robert Poon
(74) *Attorney, Agent, or Firm* — Studebaker & Brackett PC

(57) ABSTRACT

A pulp molded cushioning material includes a hollow fitting portion, into which an end portion of an article is fitted. The pulp molded cushioning material includes a main body, a cushioning portion, and a protrusion. The cushioning portion is integrally formed with the main body and protrudes in a first direction from a peripheral edge of the main body to form the fitting portion together with the main body. The protrusion is integrally formed with the main body and takes a first posture. The protrusion is changeable in posture from the first posture to a second posture. The first posture is a posture in which the protrusion protrudes in the first direction from the main body. The second posture is a posture in which the protrusion protrudes in a second direction across the first direction.

6 Claims, 5 Drawing Sheets

PULP MOLDED CUSHIONING MATERIAL AND PACKING CASE PROVIDED WITH SAME

INCORPORATION BY REFERENCE

The present application claims priority under 35 U.S.C. §119 to Japanese Patent Application No. 2012-189226, filed Aug. 29, 2012. The contents of this application are incorporated herein by reference in their entirety.

BACKGROUND

The present disclosure relates to a pulp molded cushioning material and a packing case for protection of an article (e.g., product) from a shock.

For image forming apparatuses, such as copiers, printers, etc., a paper feeder can be provided optionally. An image forming apparatus is arranged on the top surface of the paper feeder. A positioning pin projects from the top surface of the paper feeder. The positioning pin fixes the position of the image forming apparatus relative to the paper feeder. As a result, the conveyance position where paper is supplied from the paper feeder to the image forming apparatus 100 is determined.

In order to transport or store the paper feeder, two pieces of pulp molded cushioning materials support the opposite end portions of the paper feeder. The paper feeder supported by the two pieces of pulp molded cushioning materials is accommodated in an outer casing formed of a corrugated board sheet or the like and is transported or stored.

SUMMARY

According to the first aspect of the present disclosure, a pulp molded cushioning material is accommodated in an outer casing together with an article. The pulp molded cushioning material includes a hollow fitting portion, into which an end portion of the article is fitted. The pulp molded cushioning material includes a main body, a cushioning portion, and a protrusion. The cushioning portion is integrally formed with the main body and protrudes in a first direction from a peripheral edge of the main body to form the fitting portion together with the main body. The protrusion is integrally formed with the main body and takes a first posture. The protrusion is changeable in posture from the first posture to a second posture. The first posture is a posture in which the protrusion protrudes in the first direction from the main body. The second posture is a posture in which the protrusion protrudes in a second direction across the first direction.

According to the second aspect of the present disclosure, a packing case includes an outer casing and a pulp molded cushioning portion. The pulp molded cushioning material is accommodated in the outer casing together with an article. The pulp molded cushioning material includes a hollow fitting portion, into which an end portion of the article is fitted. The pulp molded cushioning material includes a main body, a cushioning portion, and a protrusion. The cushioning portion is integrally formed with the main body and protrudes in a first direction from a peripheral edge of the main body to form the fitting portion together with the main body. The protrusion is integrally formed with the main body and takes a first posture. The protrusion is changeable in posture from the first posture to a second posture. The first posture is a posture in which the protrusion protrudes in the first direction from the main body. The second posture is a posture in which the protrusion protrudes in a second direction across the first direction.

DETAILED DESCRIPTION

Embodiments of the present disclosure will be described below with reference to the accompanying drawings. It is noted that like numerals denote like or corresponding elements. Duplicate description shall be omitted.

[Image Forming Device and Paper Feeder]

Figure 1:
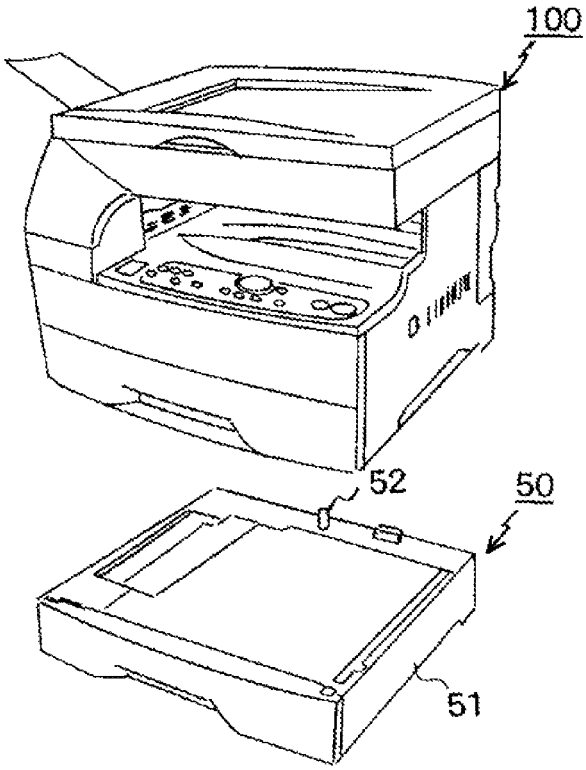
FIG. 1 is a perspective view of an image forming apparatus and a paper feeder according to one embodiment of the present disclosure.

Description will be made about an image forming apparatus 100 and a paper feeder 50 with reference to FIG. 1. FIG. 1 is a perspective view of the image forming apparatus 100 and the paper feeder 50 according to one embodiment of the present disclosure. In the present embodiment, the paper feeder 50 is referred to as one example of an article (e.g., product) for which pulp molded cushioning materials according to the present disclosure are used for transport or storage.

The paper feeder 50 is optional equipment additionally provided for the image forming apparatus 100 (e.g., copier). The image forming apparatus 100 is arranged on the top surface of the paper feeder 50. It is noted that although the paper feeder 50 is shown solely, a plurality of paper feeders 50 may be stacked below the image forming apparatus 100 as usage.

The paper feeder 50 includes a main body 51 in a box shape. Plural pieces of paper (not shown) are stacked and accommodated in the interior of the main body 51. A positioning pin 52 perpendicularly projects from the top surface in one end part of the main body 51. The positioning pin 52 fixes the position of the image forming apparatus 100 relative to the paper feeder 50. Specifically, when the positioning pin 52 is inserted in an engaging hole (not shown) formed in the bottom surface of the image forming apparatus 100, the image forming apparatus 100 is accurately positioned relative to the paper feeder 50. As a result, the conveyance position where paper is supplied from the paper feeder 50 to the image forming apparatus 100 is determined.

With reference to FIGS. 1-8, a pulp molded cushioning material 1 used for transport or storage of the paper feeder 50 will be described in detail next. "The basic principle", "structure", and "use state" of the pulp molded cushioning material 1 will be described in this order. Then, "Related Arts" and "Comparison" will be described with reference to FIGS. 8-10.

Figure 2:
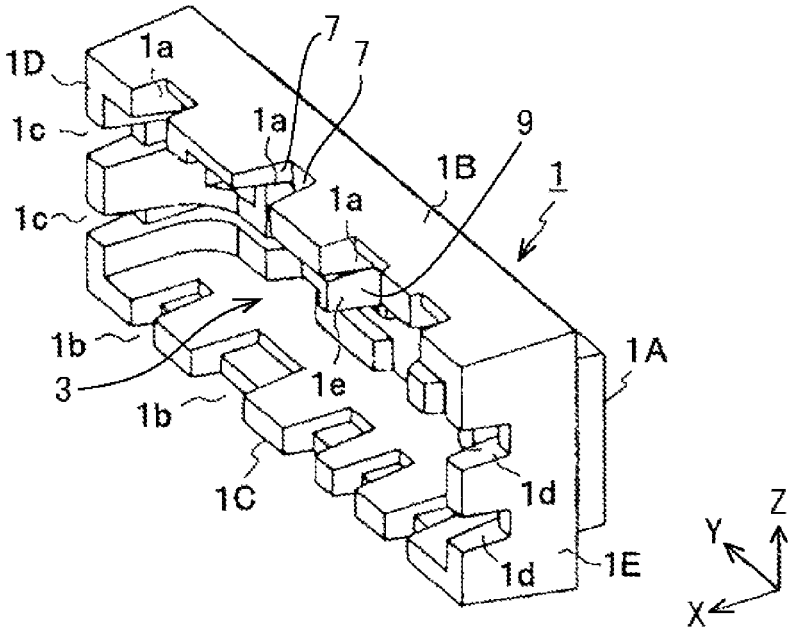
FIG. 2 is a perspective view showing a pulp molded cushioning material before use according to one embodiment of the present disclosure.
Figure 3:
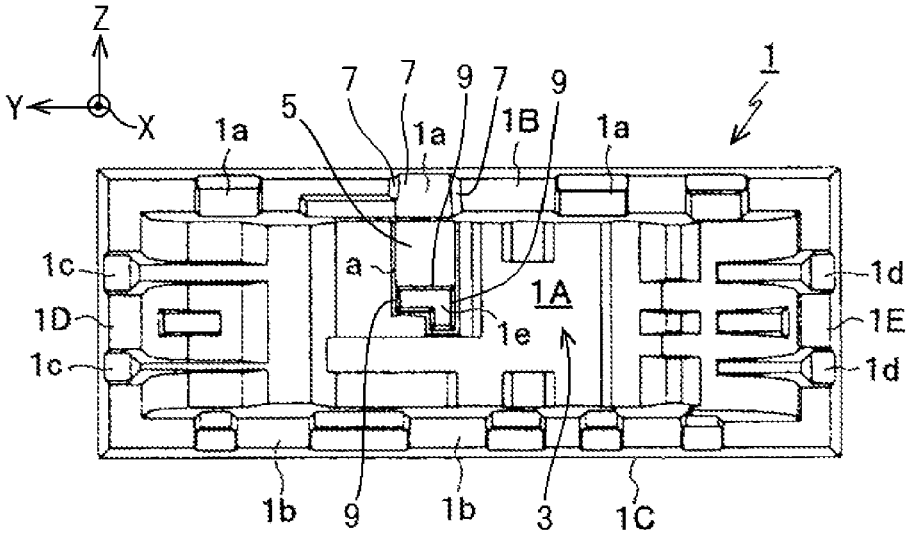
FIG. 3 is an interior view showing the pulp molded cushioning material before use according to one embodiment of the present disclosure.
Figure 4:
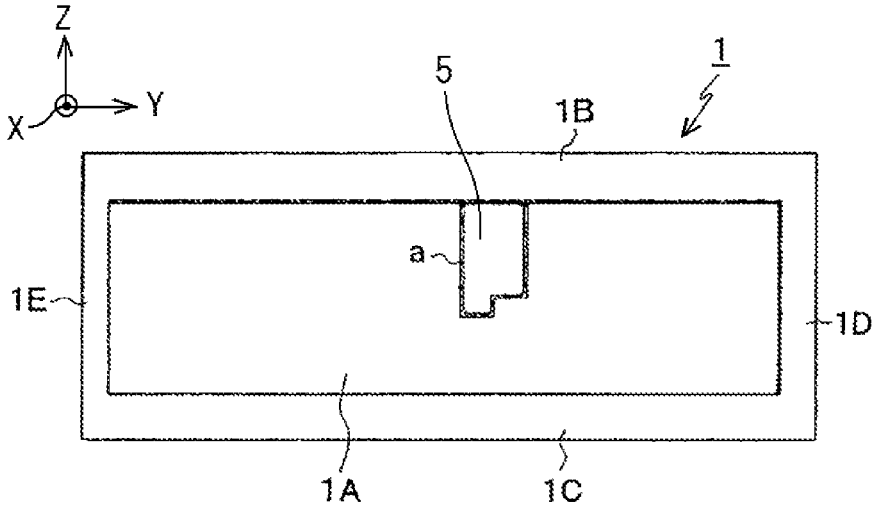
FIG. 4 is an exterior view showing the pulp molded cushioning material before use according to one embodiment of the present disclosure.

FIGS. 2, 3, and 4 are a perspective view, an interior view, and an exterior view of the pulp molded cushioning material 1 before use, respectively, according to one embodiment of the present disclosure. FIGS. 5, 6, 7, and 8 are a perspective view, an interior view, a plan view, and a partial side cross sectional view of the pulp molded cushioning material 1 in use, respectively, according to the embodiment of the present disclosure.

The pulp molded cushioning material 1 is a member formed in an integrated manner by die molding of a pulpwood. It is noted that two pulp molded cushioning materials 1 are used in pair for one paper feeder 50. Since the two pulp molded cushioning materials 1 are the same in basic configuration, only one of the pulp molded cushioning materials 1 will be described.

[Basic Principle]

Referring to FIGS. 2-4, the pulp molded cushioning material 1 includes a main body portion 1A, a cushioning portion 1B, a cushioning portion 1C, a cushioning portion 1D, a cushioning portion 1E, and a dummy rib 1*e*. The dummy rib 1*e* is one example of a protrusion. The cushioning portions 1B-1E are integrally formed with the main body portion 1A. A hollow fitting portion 3, into which an end portion of the paper feeder 50 is fitted, is formed in the pulp molded cushioning material 1 (see FIG. 8). The pulp molded cushioning material 1 is accommodated in an outer casing 2 together with the paper feeder 50 (see FIG. 8). The cushioning portions 1B-1E protrude from the peripheral edge of the main body portion 1A in a first direction to form the fitting portion 3 together with the main body portion 1A. The first direction is a direction along the X axis in the present embodiment. For example, the X axis and the Y axis are parallel to the horizontal plane, while the Z axis is parallel to the vertical line.

The dummy rib 1*e* is integrally formed with the main body portion 1A and takes a first posture (see FIG. 2). The dummy rib 1*e* is changeable in posture from the first posture to a second posture (see FIGS. 5 and 8). The first posture is a posture in which the dummy rib 1*e* protrudes from the main body portion 1A in the first direction (see FIG. 2). The second posture is a posture in which the dummy rib 1*e* protrudes in the second direction across the first direction (see FIG. 5). The second direction is a direction along the Z axis in the present embodiment. Accordingly, the first direction crosses the second direction orthogonally in the present embodiment.

According to the present embodiment, the dummy rib 1*e* is changed in posture to change the direction in which the dummy rib 1*e* protrudes from the first direction to the second direction. This can result in suppression of increase in size of the pulp molded cushioning material 1 and partial enhancement of the cushioning performance of the pulp molded cushioning material 1. For example, in change in posture, the dummy rib 1*e* is disposed in the vicinity of the positioning pin 52 of the paper feeder 50 to enhance the cushioning performance in the vicinity of the positioning pin 52 (see FIG. 8). This can suppress increase in size of the pulp molded cushioning material 1 and can protect the positioning pin 52.

[Structure]

The pulp molded cushioning material 1 includes the main body portion 1A, the cushioning portions 1B-1E, and the dummy rib 1*e*, which are integrally formed together. The pulp molded cushioning material 1 has a side cross section substantially in a rotated W-shape (see FIG. 8). Further, the pulp molded cushioning material 1 includes the fitting portion 3 as a hollow. The fitting portion 3 has an inner shape corresponding to the outer contour of the end portion of the paper feeder 50.

The cushioning portions 1B-1E are formed around the main body portion 1A. That is, the cushioning portion 1B and the cushioning portion 1C are formed at the upper and lower parts of the main body portion 1A, respectively. The cushioning portion 1D and the cushioning portion 1E are formed at the respective opposite side parts of the main body portion 1A. When viewed in cross section, each cushioning portion 1B-1E is in a rotated trapezoidal shape, which opens and expands outward (in the negative direction of the X axis) (see FIG. 8). It is noted that the reason why each cushioning portion 1B-1E is formed in the trapezoidal shape that opens and expands in one direction is to facilitate mounting of mold dies and to secure the gradient for mold die pulling in formation.

Further, a plurality of recesses 1*a*, a plurality of recesses 1*b*, a plurality of recesses 1*c*, and a plurality of recesses 1*d* are formed in the cushioning portion 1B, the cushioning portion 1C, the cushioning portion 1D, and the cushioning portion 1E, respectively. Each of the recesses 1*a* and 1*b* is trapezoidal in shape when viewed in plan (viewed in the Z axis) (see FIG. 7). Each of the recesses 1*c* and 1*d* is trapezoidal in shape when viewed from a side (viewed in the Y axis). Each of the recesses 1*a*-1*e* expands inward (in the positive direction of the X axis).

The dummy rib 1*e* protrudes in the first direction (inward) from a portion 5 of the main body portion 1A, at which no reinforcement by any ribs is necessary (hereinafter referred to as a "protrusion forming portion 5"), and takes the first posture (see FIG. 2). The term "no reinforcement by any ribs is necessary" means that no reinforcement of the main body portion 1A itself is necessary. The dummy rib 1*e* has a tapered shape that reduces in thickness as it goes toward its distal end. A cutting line a is formed along part of the perimeter of the protrusion forming portion 5 (i.e., part of the perimeter of the base end of the dummy rib 1*e*) (see FIGS. 3 and 4).

[Use State]

Figure 8:
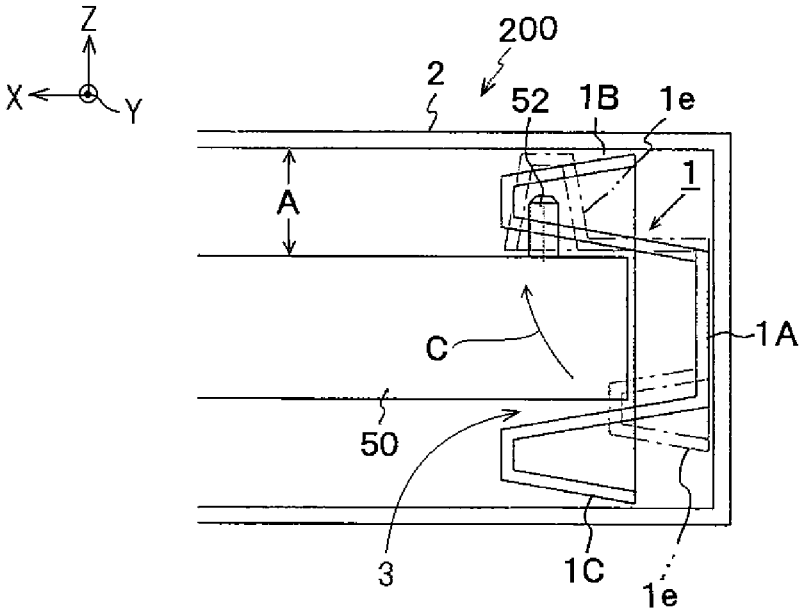
FIG. 8 is a partial side cross sectional view showing the pulp molded cushioning material in use according to one embodiment of the present disclosure.

Referring to FIG. 8, a packing case 200 includes the pulp molded cushioning materials 1 and the outer casing 2. In order to transport or store the paper feeder 50, the pulp molded cushioning materials 1 are fitted into the opposite end portions of the paper feeder 50 (one of the end portions is shown in FIG. 8). Accordingly, the one pair of pulp molded cushioning materials 1 support the opposite end portions of the paper feeder 50. The paper feeder 50, of which the opposite end portions are supported by the pulp molded cushioning materials 1, is accommodated in the outer casing 2 together with the pulp molded cushioning materials 1. Thus, the paper feeder 50 is transported or stored with it supported by the pulp molded cushioning materials 1. The outer casing 2 is formed of a corrugated board sheet, for example.

The cushioning performance of each pulp molded cushioning material 1 in supporting the paper feeder 50 is enhanced in the following manner in the present embodiment. Before the pulp molded cushioning material 1 is used (before the paper feeder 50 is fitted into the pulp molded cushioning material 1), the part of the perimeter of the protrusion forming portion 5 of the main body portion 1A (i.e., the part of the perimeter of the base end of the dummy rib 1*e*) is cut along the cutting line a (see FIGS. 3 and 4). It is noted that since the cutting line a is formed in the part of the perimeter of the protrusion forming portion 5, part to be cut can be easily specified.

Next, the protrusion forming portion 5, on which the dummy rib 1*e* is formed so as to protrude in the first posture, is folded along part of the perimeter of the protrusion forming portion 5, along which no cutting line a is formed. This changes the posture of the dummy rib 1*e*. In this case, the protrusion forming portion 5 is folded by about 90° toward the cushioning portion 1B (direction of the arrow C). It is noted that the dummy rib 1*e* before and after being folded is indicated by the dashed lines in FIG. 8.

Figure 5:
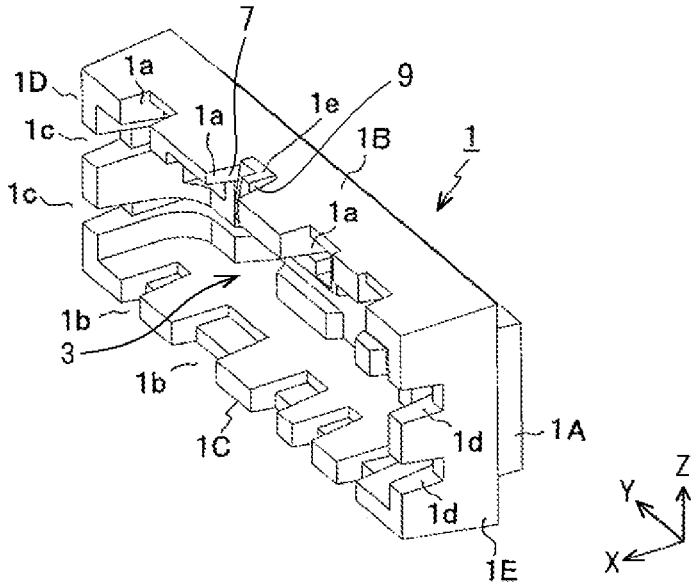
FIG. 5 is a perspective view showing the pulp molded cushioning material in use according to one embodiment of the present disclosure.
Figure 6:
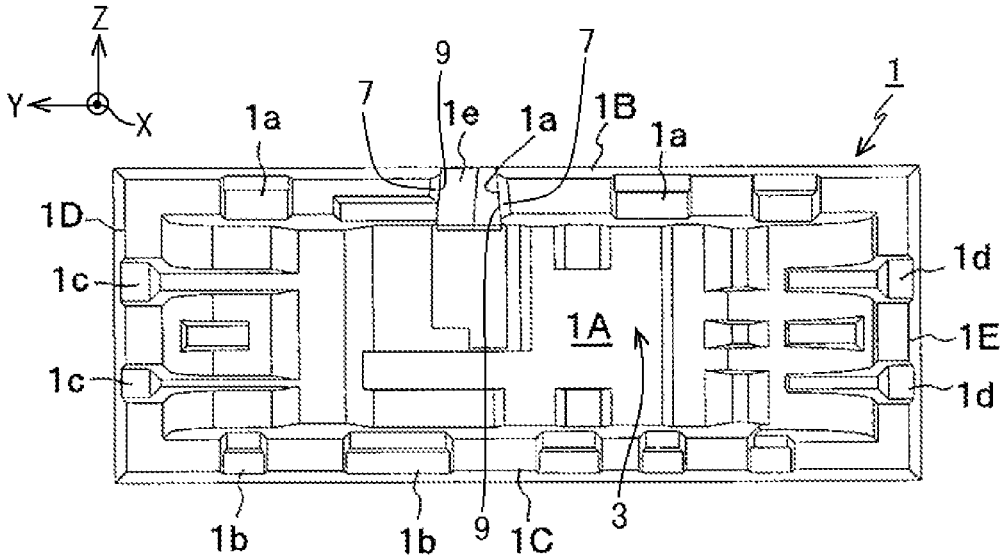
FIG. 6 is an interior view showing the pulp molded cushioning material in use according to one embodiment of the present disclosure.
Figure 7:
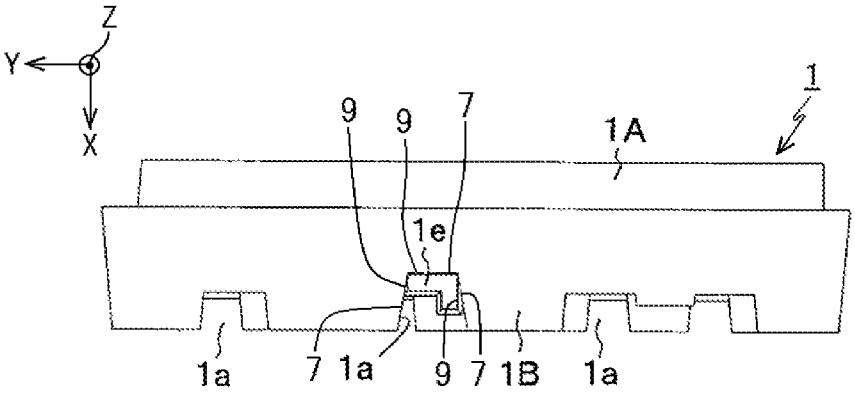
FIG. 7 is a plan view showing the pulp molded cushioning material in use according to one embodiment of the present disclosure.

Subsequently, the dummy rib 1*e* protruding from the folded protrusion forming portion 5 is fitted and held in one of the recesses 1*a* formed in the cushioning portion 1B (see FIGS. 5-7). This changes the posture of the dummy rib 1*e* to allow the dummy rib 1*e* protruding in the first direction to protrude in the second direction (change from the first posture to the second posture). That is, the dummy rib 1*e* is fitted in the one of the recesses 1*a* in the second posture. For example, the recess 1*a* in which the dummy rib 1*e* is fitted is one of the plurality of recesses 1*a*, which is located in the vicinity of the positioning pin 52 when the pulp molded cushioning material 50 is fitted in the end portion of the paper feeder 50 (see FIG. 8).

Thereafter, the pulp molded cushioning material 1 holding the dummy rib 1*e* in the recess 1*a* is fitted into the end portion of the paper feeder 50 (see FIG. 8). At this time, the dummy rib 1*e* protrudes in the second direction. Accordingly, the dummy rib 1*e* can reinforce part of the cushioning portion 1B of the pulp molded cushioning material 1, which is in the vicinity of the positioning pin 52 (partial reinforcement). That is, the dummy rib 1*e* supports the cushioning portion 1B in the second direction in the second posture.

It is noted that the dummy rib 1*e* has a side surface 9 and reduces in thickness as it goes from its base end to its distal end. A wall surface 7, which forms the recess 1*a* in the cushioning portion 1B, inclines correspondingly to the side surface 9 of the dummy rib 1*e* in the second posture. Accordingly, when the dummy rib 1*e* is changed in posture to be fitted in the recess 1*a*, the dummy rib 1*e* can stably support the cushioning portion 1B even if the cushioning portion 1B receives pressure from above. Further, when the pulp molded cushioning portion 1 is fitted in the end portion of the paper feeder 50, the base end of the dummy rib 1*e* in the second posture comes in contact with the upper surface of the end portion of the paper feeder 50 (see FIG. 8). Accordingly, the dummy rib 1*e* is supported by the paper feeder 50. This can prevent the dummy rib 1*e* from dangling, so that the dummy rib 1*e* is maintained in the second posture.

[Related Arts]

Figure 9:
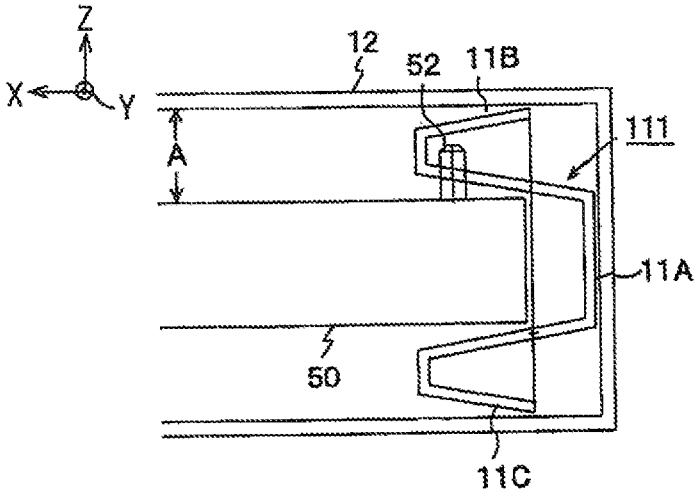
Related Art FIG. 9
FIG. 9 is a partial side cross sectional view showing a pulp molded cushioning material in use according to Related Art 1.
Figure 10:
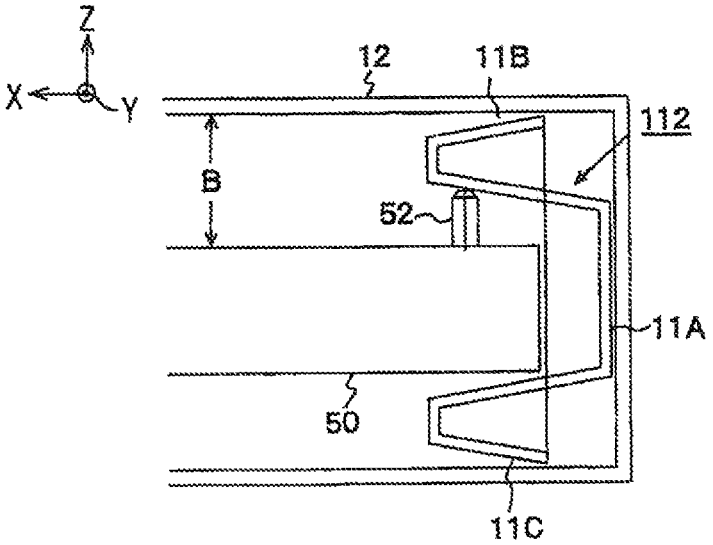
Related Art FIG. 10
FIG. 10 is a partial side cross sectional view showing a pulp molded cushioning material in use according to Related Art 2.

With reference to FIGS. 9 and 10, description will be made about Related Arts 1 and 2. FIG. 9 is a partial cross sectional view showing a pulp molded cushioning material 111 in use according to Related Art 1. FIG. 10 is a partial side cross sectional view showing a pulp molded cushioning material 112 in use according to Related Art 2. The pulp molded cushioning materials 111 and 112 each include a main body 11A and cushioning portions 11B and 11C. The paper feeder 50 supported by the pulp molded cushioning material 111 or 112 is accommodated in an outer casing 12.

The characteristics in Related Art 1 will be described. One end portion of the paper feeder 50 is fitted in the pulp molded cushioning material 111. This can result in that the cushioning portion 11B of the pulp molded cushioning material 111 can protect the positioning pin 52 perpendicularly projecting from the top surface of the paper feeder 50. In this case, the cushioning portion 11B overlaps with the positioning pin 52. The distance from the base end of the positioning pin 52 to the outer casing 12 (hereinafter referred to as "cushioning distance") is a given distance A.

Further, as one structural problem, in order for the cushioning portion 11B to protect the positioning pin 52, the cushioning portion 11B must have a long distance from its base end to its distal end. However, the cushioning portion 11B is inclined as it goes to the distal end to secure the gradient necessary for mold die pulling. Therefore, when the distal end portion of the cushioning portion 11B receives pressure from above, the cushioning portion 11B is like a cantilever to warp downward. This may lead to insufficient protection of the positioning pin 52.

The characteristics in Related Art 2 will be described. The pulp molded cushioning material 112 is formed so that the cushioning portion 11B comes in contact with the top of the positioning pin 52. Accordingly, in Related Art 2, a cushioning distance B can be secured longer than the cushioning distance A in Related Art 1. Accordingly, the cushioning performance of the pulp molded cushioning material 112 is higher than that of the pulp molded cushioning material 111. However, the cushioning distance B being longer than the cushioning distance A means the pulp molded cushioning material 112 being larger in size than the pulp molded cushioning material 111. This may increase cost and space for storage in Related Art 2.

[Comparison]

With reference to FIGS. 8-10, comparison will be made between the pulp molded cushioning material 1 according to the present embodiment and the pulp molded cushioning materials 111 and 112 respectively according to Related Arts 1 and 2. In the case using the pulp molded cushioning material 1, the distance from the base end of the positioning pin 52 to the outer casing 2 (hereinafter referred to as a "cushioning distance") is a given distance A. The pulp molded cushioning material 1 is formed so that the cushioning portion 1B overlaps with the positioning pin 52 projecting from the top surface of the paper feeder 50. Accordingly, the cushioning distance A of the pulp molded cushioning material 1 is shorter than the cushioning distance B of the pulp molded cushioning material 112, similar to that of the cushioning distance A of the pulp molded cushioning material 111. This can reduce the size of the pulp molded cushioning material 1 and the outer casing 2 in the present embodiment when compared with the pulp molded cushioning material 112, thereby achieving reduction in cost and space.

Further, in the pulp molded cushioning material 1 according to the present embodiment, the dummy rib 1*e*, which is changed in posture from the first posture to the second posture, can partially reinforce part of the cushioning portion 1B, which is in the vicinity of the positioning pin 52 (partial reinforcement). Thus, despite the fact that the cushioning distance A of the pulp molded cushioning material 1 is shorter than the cushioning distance B of the pulp molded cushioning material 112 and equal to the cushioning distance A of the pulp molded cushioning material 111, the cushioning performance of the pulp molded cushioning material 1 is higher than that of the pulp molded cushioning material 111. Thus, the pulp molded cushioning material 1 can protect the positioning pin 52 more effectively than the pulp molded cushioning material 111.

As described above, in the present embodiment, the cushioning distance A of the pulp molded cushioning material 1 is set comparatively short to achieve reduction in size and cost of the pulp molded cushioning material 1. In general, a short cushioning distance may impair the cushioning performance. To the contrary, in the present embodiment, the cushioning performance is enhanced in the following manner. Part of the perimeter of the protrusion forming portion 5, in which the dummy rib 1*e* is formed integrally, is cut, and the protrusion forming portion 5 is folded. By folding the protrusion forming portion 5, the dummy rib 1*e* is moved to the vicinity of the positioning pin 52 of the paper feeder 50. This can allow the dummy rib 1*e* to reinforce part of the cushioning portion 1B of the pulp molded cushioning material 1, which is in the vicinity of the positioning pin 52 (partial reinforcement). Moreover, the dummy rib 1*e* can enhance the cushioning performance against pressure from above to the part of the cushioning portion 1B, which is in the vicinity of the positioning pin 52.

The specific example is as follows. The dummy rib 1*e* has a tapered shape that reduces in thickness as it goes toward its distal end. Accordingly, in the state in which the dummy rib 1*e* is fitted in the recess 1*a* of the cushioning portion 1B, even when the cushioning portion 1B receives pressure force from above, the dummy rib 1*e* can serve as a support to reduce downward deformation of the cushioning portion 1B. Thus, the positioning pin 52 can be protected. In other words, the cushioning performance of the pulp molded cushioning material 1 can be partially enhanced, so that the pulp molded cushioning material 1 can protect the positioning pin 52 of the paper feeder 50 from a shock.

Thus, increase in cost and size of the pulp molded cushioning material 1 can be suppressed. Further, the positioning pin 52 of the paper feeder 50 can be protected to reduce breakage and deformation of the positioning pin 52.

Furthermore, in the present embodiment, the protrusion forming portion 5 is folded, and the dummy rib 1*e* is fitted and held in the recess 1*a* of the cushioning portion 1B. This can securely fix the dummy rib 1*e* to part for which reinforcement is necessary (the vicinity of the positioning pin 52 of the paper feeder 50), thereby allowing the dummy rib 1*e* to exhibit its function.

It is noted that the present disclosure is not limited to the above embodiment and can be reduced in practice in various embodiments. Following modifications are possible, for example.

(1) In the embodiment described with reference to FIGS. 1-8, the part of the protrusion forming portion 5 is cut, and the protrusion forming portion 5 is folded, thereby changing the dummy rib 1*e* in posture from the first posture to the second posture. However, the dummy rib 1*e* may be changed in posture from the first posture to the second posture by cutting the dummy rib 1*e* apart from the main body portion 1A. For example, the dummy rib 1*e* may be cut apart from the main body portion 1A and be moved to the vicinity of the positioning pin 52 of the paper feeder 50.

(2) The shape of the dummy rib 1*e* is not limited to that shown in FIGS. 2-8. For example, the dummy rib 1*e* may have a shape of a prism, frustum (e.g., frustum of cone, frustum of pyramid), or cylinder.

(3) In the embodiment described with reference to FIGS. 1-8, a paper feeder, which is additionally provided for an image forming apparatus, is described to as one example of a product to which the pulp molded cushioning material according to the present disclosure is applied. However, the pulp molded cushioning material according to the present disclosure is applicable likewise to any other products having a projection projecting from its outer surface.

(4) In the embodiment described with reference to FIGS. 2-8 and the modified example described in (1), the protrusion forming portion 5, in which the dummy rib 1*e* is formed, is folded, or the dummy rib 1*e* is cut apart from the main body portion 1A. Then, the dummy rib 1*e* is moved to the vicinity of a projection (e.g., the positioning pin 52) of a product (e.g., the paper feeder 50). Accordingly, the dummy rib 1*e* can increase the strength of part of the pulp molded cushioning material 1, which is in the vicinity of the projection of the product. This can partially enhance the cushioning performance of the pulp molded cushioning material 1, so that the pulp molded cushioning material 1 can protect the projection of the product from a shock. Accordingly, the projection of the product can be protected to reduce breakage and deformation of the projection, while increase in cost and size of the pulp molded cushioning material 1 can be suppressed.

(5) In the embodiment described with reference to FIGS. 2-8 and the modified example described in (1), the dummy rib 1*e*, which is folded or cut apart to be changed in posture, is fitted and held in the recess 1*a* of the cushioning portion 1B. This can securely fix the dummy rib 1*e* to part for which reinforcement is necessary (i.e., the vicinity of the projection of the product), thereby allowing the dummy rib 1*e* to exhibit its function.

(6) In the embodiment described with reference to FIGS. 2-8, the wall surface 7 that forms the recess 1*a* in which the dummy rib 1*e* is fitted inclines correspondingly to the side surface 9 of the dummy rib 1*e*. Thus, the dummy rib 1*e* can stably support the cushioning portion 1B even when the cushioning portion 1B of the pulp molded cushioning material 1 receives pressure from above.

What is claimed is:

1. A pulp molded cushioning material with a hollow fitting portion, into which an end portion of an article is fitted, comprising:

a main body; and a plurality of cushioning portions integrally formed with the main body and protruding in a first direction from a peripheral edge of the main body to form the hollow fitting portion together with the main body, wherein the main body includes a protrusion protruding from the main body, the cushioning portions have recesses notched from tip ends thereof to the main body, the protrusion is changeable in posture between a first posture in which the protrusion protrudes from the main body in the first direction in an inside of the hollow fitting portion and a second posture in which the protrusion extends in a second direction across the first direction and protrudes from the inside of the hollow fitting portion to one recess of the recesses, the protrusion in the first posture is not fitted into the one recess, the protrusion in the second posture is fitted into the one recess, the main body further includes a protrusion forming portion, on which the protrusion is formed, the protrusion forming portion is foldable by being cut at a part of a perimeter thereof, the protrusion forming portion, in the second posture of the protrusion, is folded along another part of the perimeter thereof that is not cut, the protrusion in the second posture protrudes in the second direction from the folded protrusion forming portion to be fitted in the one recess, the protrusion in the second posture reinforces part of one of the cushioning portions that has the one recess to which the protrusion is fitted, a cutting line is formed on the part of the perimeter of the protrusion forming portion, and the protrusion forming portion, in the second posture of the protrusion, is folded along another part of the perimeter thereof along which no cutting line is formed.

2. A pulp molded cushioning material according to claim 1, wherein the protrusion has a side surface and reduces in thickness as it goes from its base end to its distal end, and a wall surface, which forms the one recess, inclines correspondingly to the side surface of the protrusion in the second posture.

3. A pulp molded cushioning material according to claim 1, wherein each of the recesses is formed in an inwardly expanding trapezoidal shape when viewed in plan.

4. A pulp molded cushioning material according to claim 1, wherein the protrusion has a side surface and reduces in thickness as it goes from its base end to its distal end, and a wall surface, which forms the one recess, inclines relative to the second direction correspondingly to the side surface of the protrusion in the second posture, the one recess being tapered outward of the hollow fitting portion.

5. A pulp molded cushioning material according to claim 1, wherein the protrusion is a dummy rib.

6. A packing case, comprising:

an outer casing; and a pulp molded cushioning material with a hollow fitting portion, into which an end portion of an article is fitted, wherein the pulp molded cushioning material includes:

a main body; and a plurality of cushioning portions integrally formed with the main body and protruding in a first direction from a peripheral edge of the main body to form the hollow fitting portion together with the main body, wherein the main body includes a protrusion protruding from the main body, the cushioning portions have recesses notched from tip ends thereof to the main body, the protrusion is changeable in posture between a first posture in which the protrusion protrudes from the main body in the first direction in an inside of the hollow fitting portion and a second posture in which the protrusion extends in a second direction across the first direction and protrudes from the inside of the hollow fitting portion to one recess of the recesses, the protrusion in the first posture is not fitted into the one recess, the protrusion in the second posture is fitted into the one recess, the main body further includes a protrusion forming portion, on which the protrusion is formed, the protrusion forming portion is foldable by being cut at a part of a perimeter thereof, the protrusion forming portion, in the second posture of the protrusion, is folded along another part of the perimeter thereof that is not cut, the protrusion in the second posture protrudes in the second direction from the folded protrusion forming portion to be fitted in the one recess, the protrusion in the second posture reinforces part of one of the cushioning portions that has the one recess to which the protrusion is fitted a cutting line is formed on the part of the perimeter of the protrusion forming portion, and the protrusion forming portion, in the second posture of the protrusion, is folded along another part of the perimeter thereof along which no cutting line is formed.

* * * * *